US005138749A

United States Patent [19]

McCune et al.

[11] Patent Number: 5,138,749

[45] Date of Patent: Aug. 18, 1992

[54] TONGUE ASSEMBLY

[75] Inventors: Phillip H. McCune, Mt. Clemens; Keith R. Ball, New Baltimore, both of Mich.

[73] Assignee: TRW Vehicle Safety Systems Inc., Lyndhurst, Ohio

[21] Appl. No.: 744,341

[22] Filed: Aug. 13, 1991

[51] Int. Cl.[5] ..... A44B 11/12

[52] U.S. Cl. ..... 24/196; 24/170; 24/194

[58] Field of Search ..... 24/196, 197, 194, 170, 24/171, 168; 297/476, 468, 483

[56] References Cited

U.S. PATENT DOCUMENTS

| | | | |
|---|---|---|---|
| 855,521 | 5/1907 | Kirby | 24/194 |
| 1,470,843 | 10/1923 | Johnson | 24/194 |
| 2,836,868 | 6/1958 | Carter | 24/196 |
| 3,402,439 | 9/1968 | Currat | 24/194 |
| 3,505,711 | 4/1970 | Carter | 24/196 |
| 4,551,889 | 11/1985 | Narayan, et al. | 24/196 |
| 4,726,625 | 2/1988 | Bougher | 24/170 |
| 4,871,190 | 10/1989 | Willey | 24/196 |
| 5,058,244 | 10/1991 | Fernandez | 24/196 |

*Primary Examiner*—Victor N. Sakran

*Attorney, Agent, or Firm*—Tarolli, Sundheim & Covell

[57] ABSTRACT

A tongue assembly for use in a safety apparatus in which belt webbing restrains movement of an occupant of a vehicle or of a child seat includes a metal base. The base has a passage through which the belt webbing extends. A plastic cover is fixed to the base and has a belt clamping portion. The tongue assembly also includes a slide bar around which the belt webbing extends. The slide bar is movable relative to the base and cover between a first position in which the slide bar clamps the belt webbing against the belt clamping portion of the cover to block movement of the belt webbing through the passage and a second position in which the belt webbing is movable through the passage.

8 Claims, 3 Drawing Sheets

TONGUE ASSEMBLY

BACKGROUND OF THE INVENTION

1. Technical Field

The present invention relates to a tongue assembly for use in a vehicle seat belt system for restraining movement of an occupant of a vehicle.

2. Description of the Prior Art

A known vehicle seat belt system is a three-point continuous loop seat belt system. A three-point continuous loop seat belt system includes a seat belt retractor and a length of belt webbing. The belt webbing extends from the retractor through a D-ring fixed to the vehicle and then down to an anchor point near the vehicle floor. A tongue assembly is slidable along the belt webbing. To use the seat belt system, a vehicle occupant grasps the tongue assembly and inserts it into a buckle. When the tongue assembly is fastened in the buckle, a portion of the belt webbing extends across the lap of the vehicle occupant and a portion of the belt webbing extends diagonally across the torso of the vehicle occupant.

A three-point continuous loop seat belt system may sometimes be used to secure a child seat in the vehicle seat. In this case, it is necessary to fix the length of the lap portion of the belt webbing, so that the child seat can not move relative to the vehicle seat. Thus, it is desirable that a tongue assembly for a three-point continuous loop seat belt system be able to block movement of the belt webbing through the tongue assembly when the tongue assembly is fastened in the buckle. It is also desirable that the belt webbing run relatively freely through the tongue assembly when the tongue assembly is adjacent the D-ring, so that the belt webbing can be wound on the retractor.

SUMMARY OF THE INVENTION

The present invention is a tongue assembly for use in a seat belt system in which belt webbing restrains movement of an occupant of a vehicle or of a child seat in a vehicle. The tongue assembly includes a base and a cover fixed to the base. The cover and base define a passage through which the belt webbing extends. The cover has a belt clamping portion. The tongue assembly also includes a slide bar around which the belt webbing extends. The slide bar is movable relative to the base and cover between a first position in which the slide bar clamps the belt webbing against the belt clamping portion of the cover to block movement of the belt webbing through the passage and a second position in which the belt webbing is movable through the passage.

BRIEF DESCRIPTION OF THE DRAWING

Further features of the present invention will become apparent to those skilled in the art to which the present invention relates from reading the following specification with the accompanying drawings, in which.

DESCRIPTION OF A PREFERRED EMBODIMENT OF THE INVENTION

Figure 1:
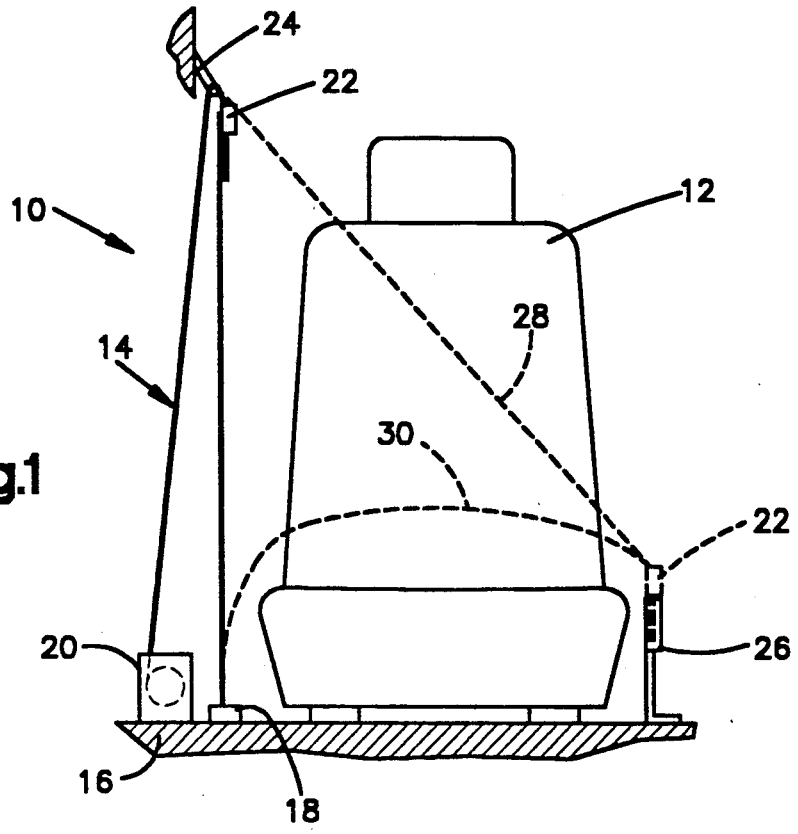
FIG. 1 is a schematic illustration of a vehicle seat belt system having a tongue assembly in accordance with the present invention.
Figure 2:
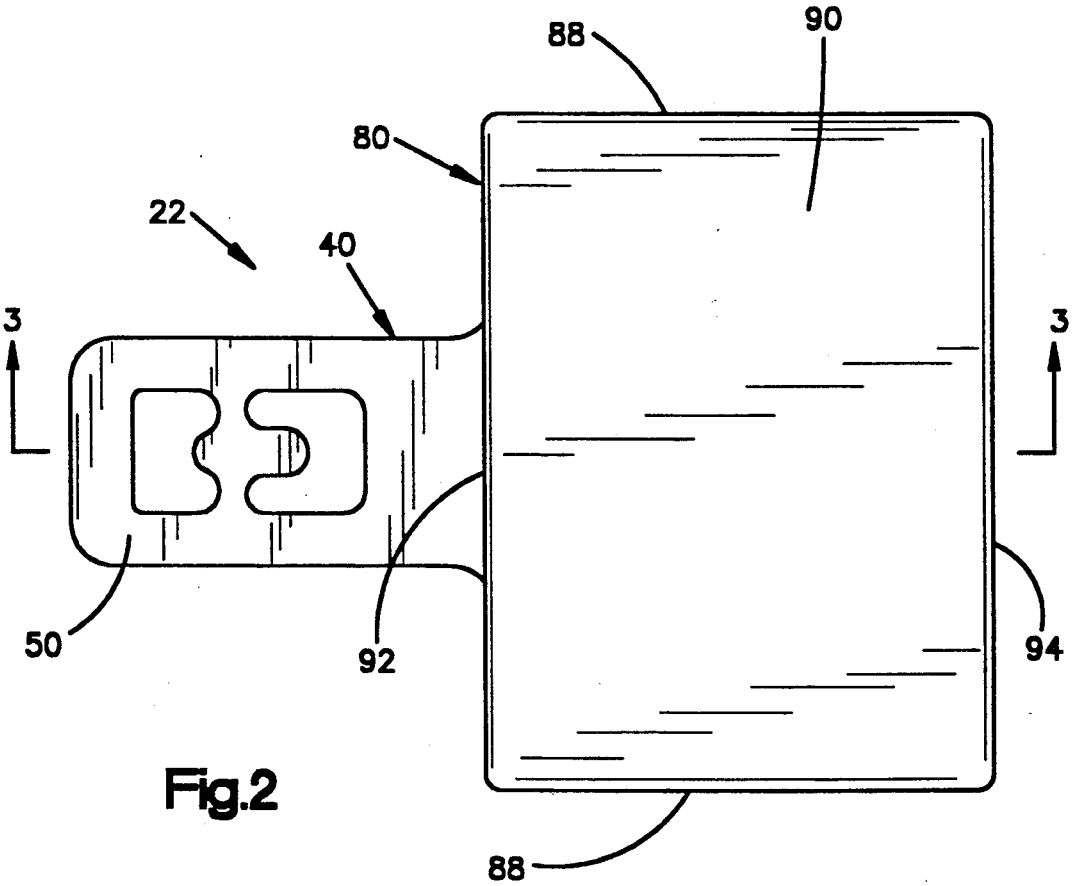
FIG. 2 is a top plan view of the tongue assembly of FIG. 1.

The present invention is illustrated in FIG. 1 as applied to a three-point continuous loop seat belt system for use in restraining an occupant of a vehicle against movement relative to the vehicle. The following description assumes that the seat belt system 10 is used in restraining a vehicle occupant. It should be understood that the seat belt system 10 could be used to restrain a child seat. It should further be understood that the invention could be applied to other belt systems.

During operation of the vehicle, an occupant of the vehicle sits on a seat 12 which is illustrated as a front passenger seat in the vehicle. A length of belt webbing 14 is extendible about the vehicle occupant. One end of the length of belt webbing 14 is anchored to the vehicle body 16 at an anchor point 18 on the outboard side of the seat 12. The opposite end of the belt webbing 14 is attached to a retractor 20 secured to the vehicle body also on the outboard side of the seat 12. Intermediate its ends, the belt webbing 14 passes through a tongue assembly 22 and through a D-ring 24 mounted on the vehicle above the retractor 20 and the anchor point 18. When the seat belt system 10 is not in use, the belt webbing 14 is wound on the retractor 20 and is oriented generally vertically on the outboard side of the seat 12, as shown in solid lines in FIG. 1.

To engage the seat belt system 10, the tongue assembly 22 is manually grasped and is pulled across the lap and torso of the occupant sitting in the seat 12. As the tongue assembly 22 is pulled across the lap and torso of the occupant, the tongue assembly 22 moves along the belt webbing 14, and the belt webbing 14 is unwound from the retractor 20. When the belt webbing 14 has been pulled across the lap and torso of the occupant, the tongue assembly 22 is connected with a buckle 26, as shown in dashed lines in FIG. 1. The buckle 26 is connected to the vehicle body 16 and is disposed on the inboard side of the seat 12 opposite the anchor point 18. When the seat belt system 10 is thus buckled the length of belt webbing 14 is divided by the tongue assembly 22 into a torso portion 28 which extends diagonally across the torso of the occupant and a lap portion 30 which extends across the lap of the occupant.

Figure 4:
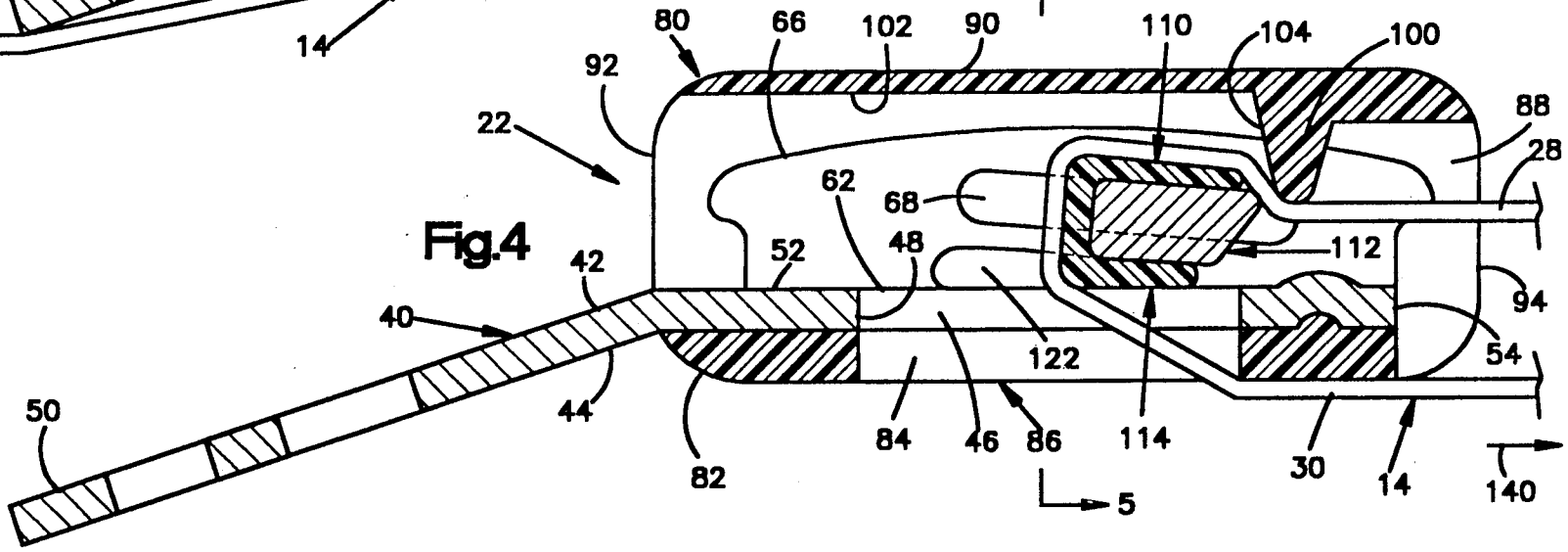
FIG. 4 is a view similar to FIG. 3 showing the tongue assembly in a belt webbing locking condition.
Figure 5:
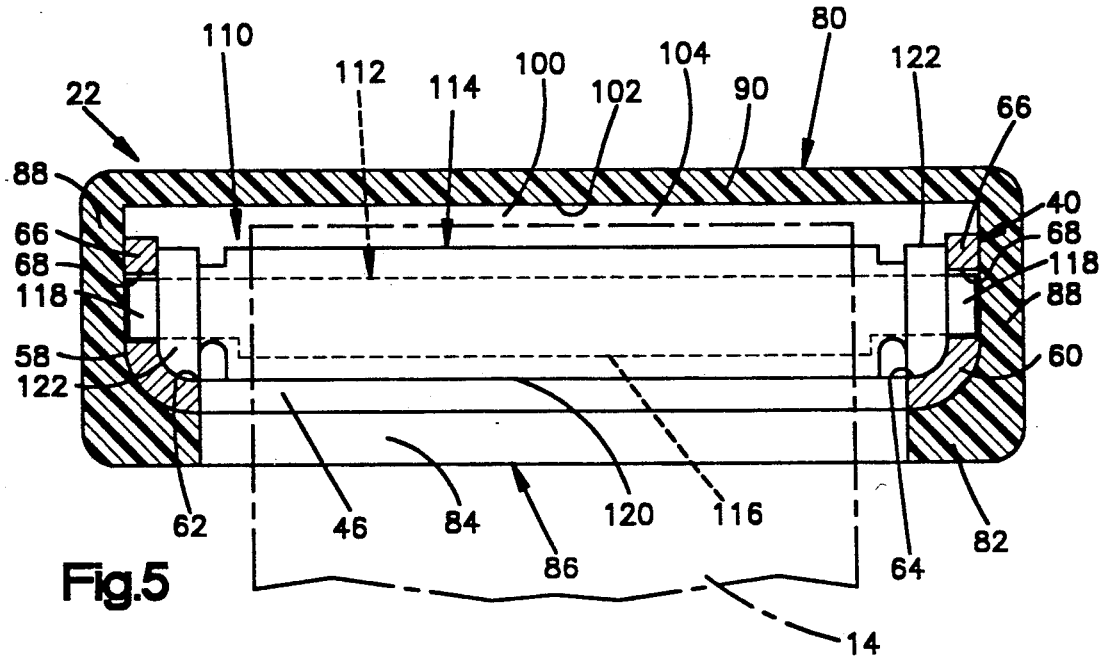
FIG. 5 is a sectional view taken along line 5—5 of FIG. 4.
Figure 6:
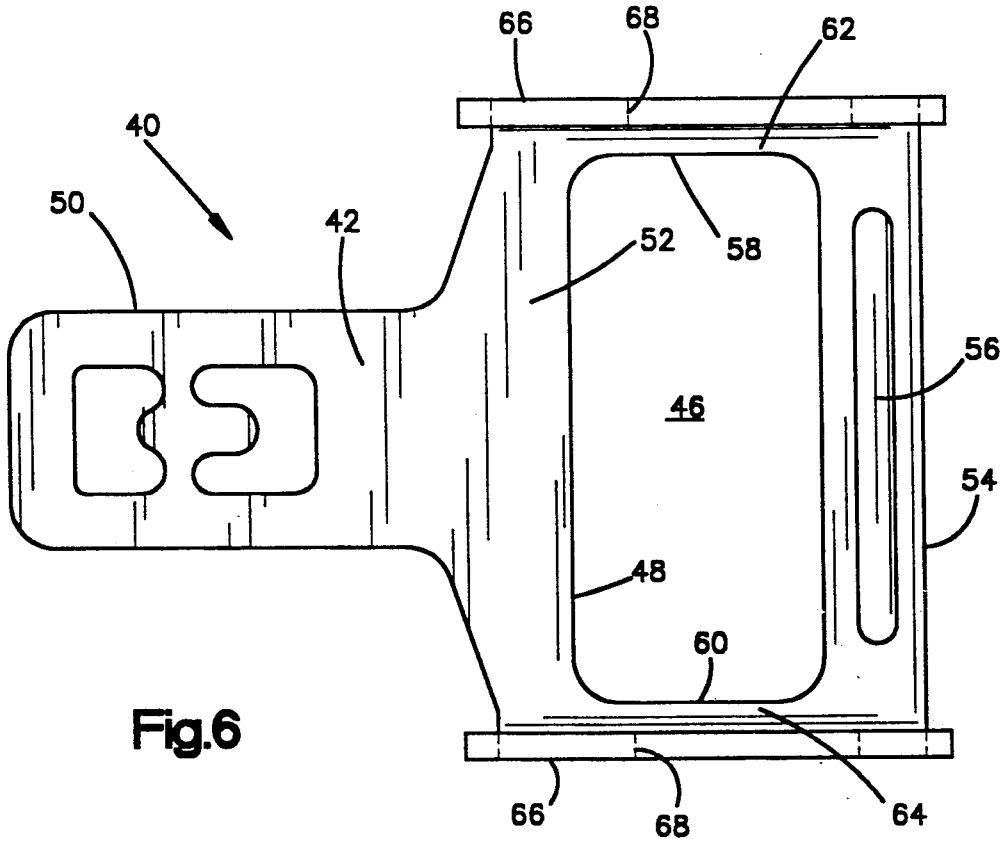
FIG. 6 is a top plan view of the base of the tongue assembly of FIG. 1.

The tongue assembly 22 includes a base 40 (FIGS. 4 and 6). The base 40 is metal and is preferably made from SAE 4130 steel which is heat treated and chrome plated. The base 40 has an upper major side surface 42 and a lower major side surface 44 (FIG. 4). A webbing opening 46 extends through the base 40 between the upper major side surface 42 and the lower major side surface 44. The webbing opening 46 is defined by an edge surface 48 (FIG. 6) of the base 40.

The base 40 includes a latching portion 50 at one end for engagement with the buckle 26 in a known manner. The base 40 also includes a leading end portion 52 adjacent the latching portion 50 and a trailing end portion 54 spaced from the leading end portion and located at the end of the base opposite the latching portion. The trailing end portion 54 has a reinforcing rib 56.

The base 40 further includes side portions 58 and 60 on opposite sides of the webbing opening 46 and extending between the leading end portion 52 and the trailing end portion 54. The side portion 58 has an upper surface 62 and the side portion 60 has an upper surface 64. A pair of flanges 66 project upward from the side portions 58 and 60, respectively. Each flange 66 has an elongate slot 68.

The tongue assembly 22 also includes a cover 80 (FIGS. 2–5). The cover 80 is preferably made from nylon and is insert molded to the base 40 in a known manner. The cover 80 includes a bottom portion 82 (FIGS. 3 and 4) having a webbing opening 84 aligned with the webbing opening 46 in the base 40. Together, the webbing opening 46 in the base 40 and the webbing opening 84 in the cover 80 constitute a passage 86 through which the belt webbing 14 extends.

The cover 80 has two side portions 88 extending upward from the cover bottom portion 82 and located outward of the base flanges 66. A top portion 90 of the cover 80 extends between the two side portions 88. Together, the cover top portion 90, the cover side portions 88, the base flanges 66 and the base leading end portion 52 define a leading end opening 92 (FIGS. 2–4) in the tongue assembly 22. Similarly, the cover top portion 90, the cover side portions 88, the base flanges 66 and the base trailing end portion 54 define a trailing end opening 94 at the opposite end of the tongue assembly 22.

The tongue assembly 22 has a belt clamping portion 100 (FIGS. 3–5), which in the preferred embodiment is molded in portion 100 of the cover 80 projects downward from a lower surface 102 of the cover top portion 90, toward the base 40. The belt clamping portion 100 is in the form of a rib which extends across the tongue assembly 22 between the cover side portions 88. An inclined clamping surface 104 of the belt clamping portion 100 is presented toward the leading end opening 92 and the latching portion 50 of the base 40. It should be understood that the belt clamping portion 100 need not be part of the cover 80 or molded with the cover 80. Rather, the belt clamping portion 100 can be a separate plastic member fixed to the base 40.

The tongue assembly 22 also includes a slide bar 110. The slide bar 110 includes a lock bar 112 and a sleeve 114 on the lock bar 112. The lock bar 112 is preferably made from SAE 1144 steel. The sleeve 114 is preferably made from injection molded polyethylene.

The lock bar 112 (FIG. 5) has a central portion 116 and two reduced section end portions 118. The end portions 118 are received in the slots 68 in the flanges 66 of the base 40. The sleeve 114 also includes a central portion 120 and two support portions 122 at its opposite ends. The central portion 120 is C-shaped and includes an upper portion 124 (FIG. 3), a leading portion 126, and a lower portion 128. The central portion 120 of the sleeve 114 fits around the lock bar central portion 116. The support portions 122 of the sleeve 114 slidably support the lock bar 112 on the upper surfaces 62 and 64 of the base side portions 58 and 60, respectively.

The belt webbing 14 (FIGS. 3–5) extends through the tongue assembly 22. From the anchor point 18, the belt webbing 14 extends through the passage 86 in the base 40 and the cover 80. The belt webbing 14 then extends between the flanges 66 of the base 40 and around the slide bar 110. Thereafter, the belt webbing 14 extends between the slide bar 110 and the belt clamping portion 100 of the cover 80, and through the trailing end opening 94 of the tongue assembly 22.

Figure 3:
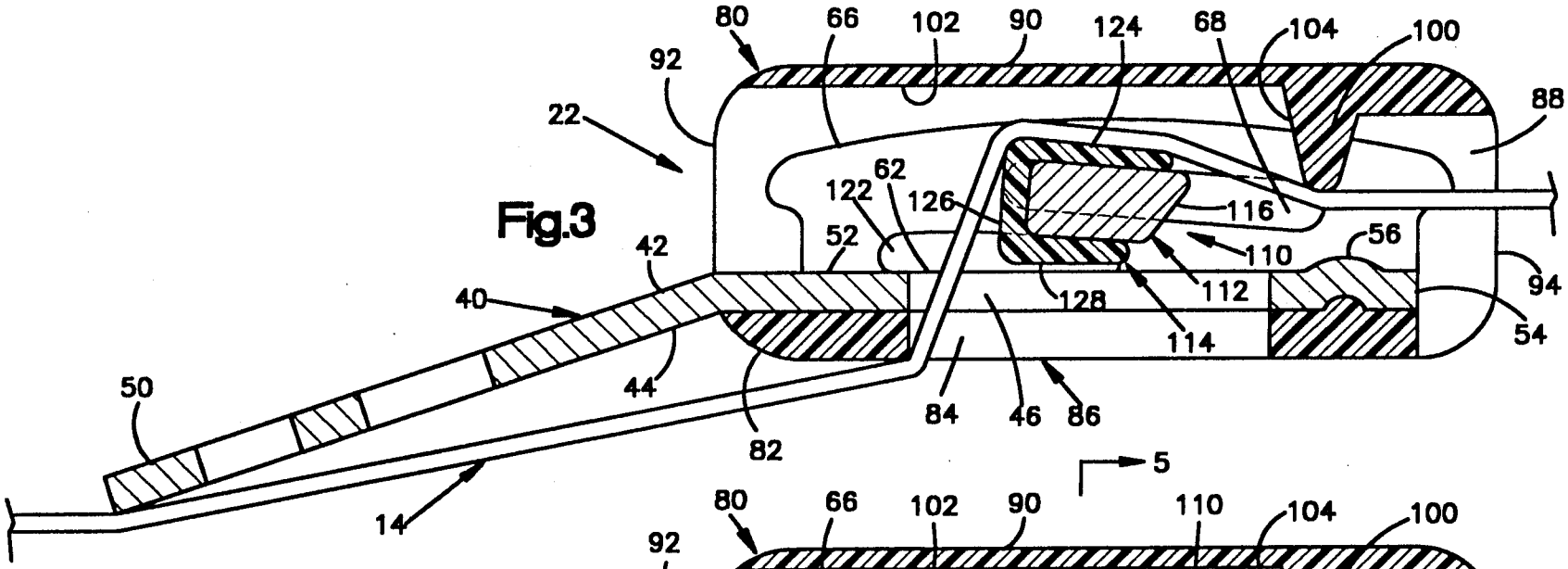
FIG. 3 is a sectional view taken along line 3—3 of FIG. 2 and showing the belt webbing extending through the tongue assembly.

FIG. 3 illustrates the parts of the tongue assembly 22 in an unlocked condition. This is the condition of the tongue assembly 22 when, for example, the belt webbing 14 of the seat belt system 10 (FIG. 1) is retracted and the tongue assembly 22 is adjacent the D-ring 24. In this unlocked condition, the slide bar 110 is positioned as viewed in FIG. 3. There is sufficient distance between the slide bar 110 and the belt clamping portion 100 of the cover 80 that the belt webbing 14 is movable through the passage 86 in the tongue assembly 22.

The vehicle occupant buckles the seat belt system 10 (FIG. 1) by engaging the latching portion 50 of the tongue assembly 22 with the buckle 26. The vehicle occupant pulls the torso portion 28 of the belt webbing 14 until enough belt webbing 14 passes through the tongue assembly 22 to make the lap portion 30 fit tightly around the occupant's lap. The vehicle occupant then releases the torso portion 28 of the belt webbing 14 and the seat belt system 10 is in the buckled condition as shown in dashed lines in FIG. 1.

The belt webbing 14 assumes a U-shape within the tongue assembly 22, as seen in FIG. 4, when the seat belt system 10 is buckled. The torso portion 28 of the belt webbing 14 extends from the trailing end opening 94 of the tongue assembly 22. The lap portion 30 of the belt webbing 14 extends from the passage 86 of the tongue assembly 22. The lap portion 30 of the belt webbing 14 is tight around the occupant's lap and is therefore under tension. This tensile force acts on the lap portion 30 of the belt webbing 14 in the direction indicated by the arrow 140 in FIG. 4. The torso portion 28 of the belt webbing 14 also may be under tensile force applied by the retractor 20.

The forces applied by the belt webbing 14 cause the slide bar 110 to move from the unlocked position shown in FIG. 3 to the belt webbing locking position shown in FIG. 4. The slide bar 110 forces the belt webbing 14 against the clamping surface 104 of the belt clamping portion 100 of the cover 80. The belt webbing 14 is clamped in the tongue assembly 22 between the slide bar 110 and the belt clamping portion 100. The length of the lap portion 30 of the belt webbing 14 is fixed and the tongue assembly 22 is thus in the belt webbing locking condition.

When the vehicle occupant unbuckles the seat belt system 10, the tension on the lap portion 30 of the belt webbing 14 is released. The retractor 20 pulls on the torso portion 28 of the belt webbing 14 and winds belt webbing on the retractor 20. The tongue assembly 22 is pulled across the torso of the vehicle occupant until the tongue assembly 22 reaches the D-ring 24. When the tongue assembly 22 reaches the D-ring 24, the tongue assembly is in a generally vertical position as illustrated in FIG. 1. The slide bar 110 is again in the unlocked position shown in FIG. 3, and the belt webbing 14 can run relatively freely through the tongue assembly 22 to be wound on the retractor 20. If the tongue assembly 22 does not reach the D-ring 24 before all the belt webbing 14 is fully retracted, the tongue assembly 22 will remain in the same position on the belt webbing 14 which the tongue assembly 22 had when it was released from the buckle 26.

As noted above, the seat belt system 10 can also be used for restraining a child seat (not shown) in the vehicle seat 12. The seat belt system 10, when used for restraining a child seat in the seat 12, is buckled so that the lap portion 30 of the belt webbing 14 holds the child seat on the vehicle seat 12. When the tongue assembly 22 is engaged in the buckle 26, the slide bar 110 is in the belt webbing locking position shown in FIG. 4. The tongue assembly 22 clamps the seat belt webbing 14 so that the lap portion 30 of the belt webbing 14 cannot be lengthened. Thus, the child seat is securely held in position on the vehicle seat 12.

From the foregoing description of the invention, those skilled in the art will perceive improvements, changes and modifications in the invention. Such improvements, changes and modifications within the skill of the art are intended to be covered by the appended claims.

We claim:

1. A tongue assembly for use in a safety apparatus in which belt webbing restrains movement, said tongue assembly comprising:

a base;

a cover defining a chamber, said cover being fixed to said base and held against movement relative to said base, said base having a portion located in said chamber, said cover and base defining a passage through which the belt webbing is extensible, said cover having a belt clamping portion; and a slide bar supported by said portion of said base and around which the belt webbing is extensible, said slide bar being located in said chamber;

said slide bar being movable relative to said base and cover under forces applied by the belt webbing between a first position in which said slide bar clamps the belt webbing against said belt clamping portion of said cover to block movement of the belt webbing through said passage and a second position in which the belt webbing is movable through said passage.

2. A tongue assembly as defined in claim 1 wherein said cover has a first portion facing said passage, said belt clamping portion comprising a member molded integrally with said first cover portion and projecting from said first cover portion toward said passage.

3. A tongue assembly as defined in claim 2 wherein said cover and said base define between them a trailing end opening through which said belt webbing is extensible, said projecting member of said cover being located intermediate said passage and said trailing end opening.

4. A tongue assembly as defined in claim 1 wherein said base includes a pair of spaced apart flanges, said belt clamping portion of said cover being disposed between said flanges, said slide bar having end portions received in slots in said flanges and a central portion disposed between said flanges, said slide bar being movable relative to said base along said slots in said flanges to clamp the belt webbing between said slide bar central portion and said belt clamping portion.

5. A tongue assembly as defined in claim 1 wherein said cover is molded to said base and includes a bottom portion partially defining said passage, a top portion having said belt clamping portion thereon, and opposite side portions extending between said top portion and said bottom portion.

6. A tongue assembly as defined in claim 1 wherein said tongue assembly has a latching portion for engagement with a buckle of said safety apparatus, said belt clamping portion of said cover has a clamping surface presented toward said latching portion, and said slide bar is disposed intermediate said latching portion and said clamping surface and is movable by forces applied by the belt webbing in a direction away from said latching portion to clamp the belt webbing against said clamping surface.

7. A tongue assembly for use in a safety apparatus in which belt webbing restrains movement, said tongue assembly comprising:

a metal base defining a passage through which the belt webbing is extensible;

a plastic member fixed to said base and having a belt clamping portion; and a slide bar around which the belt webbing is extensible;

said slide bar being movable relative to said base and plastic member under forces applied by the belt webbing between a first position in which said slide bar clamps the belt webbing against said belt clamping portion of said plastic member to block movement of the belt webbing through said passage and a second position in which the belt webbing is movable through said passage.

8. A tongue assembly as defined in claim 7 wherein said plastic member comprises a cove molded to said base and defining a chamber having said slide bar therein, said cover including a portion from which said belt clamping portion projects into the path of movement of said slide bar.

* * * * *

UNITED STATES PATENT AND TRADEMARK OFFICE

CERTIFICATE OF CORRECTION

PATENT NO. : 5,138,749

DATED : August 18, 1992

INVENTOR(S) : Phillip H. McCune and Keith R. Ball

It is certified that error appears in the above-identified patent and that said Letters Patent is hereby corrected as shown below:

Column 6, Line 43, Claim 8, change "cove" to --cover--.

Signed and Sealed this

Fourteenth Day of September, 1993

Bruce Lehman

*Attest:*

BRUCE LEHMAN

*Attesting Officer*

*Commissioner of Patents and Trademarks*